US010710389B2

(12) United States Patent
Hughes et al.

(10) Patent No.: US 10,710,389 B2
(45) Date of Patent: Jul. 14, 2020

(54) CAN IMPRINTING DEVICE AND ASSOCIATED METHODS

(71) Applicant: Crown Packaging Technology, Inc., Alsip, IL (US)

(72) Inventors: Grahame Hughes, Oxfordshire (GB); Jose Ramon Rodriguez Tellez, Lerma (MX); Jose Torres Murguia, Tonala (MX); Soraya Ramirez De Leon, Toluca (MX); Felix Hurtado, Toluca (MX)

(73) Assignee: Crown Packaging Technology, Inc., Alsip, IL (US)

( * ) Notice: Subject to any disclaimer, the term of this patent is extended or adjusted under 35 U.S.C. 154(b) by 83 days.

(21) Appl. No.: 15/711,803

(22) Filed: Sep. 21, 2017

(65) Prior Publication Data

US 2018/0086128 A1 Mar. 29, 2018

Related U.S. Application Data

(60) Provisional application No. 62/398,933, filed on Sep. 23, 2016.

(51) Int. Cl.

| | |
|---|---|
| ***B41N 10/02*** | (2006.01) |
| ***B41F 17/22*** | (2006.01) |
| ***B41F 17/28*** | (2006.01) |
| ***B41M 1/40*** | (2006.01) |

(Continued)

(52) U.S. Cl.

CPC ..... *B41N 10/02* (2013.01); *B41F 17/22* (2013.01); *B41F 17/28* (2013.01); *B41M 1/40* (2013.01); *B41C 1/05* (2013.01); *B65D 1/12* (2013.01)

(58) Field of Classification Search

CPC ..... B41F 17/14; B41F 17/18; B41F 17/20; B41F 17/28; B41F 17/006; B41F 17/22; B41F 31/16; B41F 31/20; B41F 33/00; B41P 2217/14; B41M 1/06; B41M 1/14; B41M 1/40

See application file for complete search history.

(56) References Cited

U.S. PATENT DOCUMENTS

| | | | |
|---|---|---|---|
| 4,741,266 | A | 5/1988 | Stirbis et al. |
| 8,365,658 | B2 | 2/2013 | Ouchi |

(Continued)

FOREIGN PATENT DOCUMENTS

| | | | |
|---|---|---|---|
| CO | 5730007 | A1 | 2/2007 |
| WO | WO 2014/008544 | A1 | 1/2014 |
| WO | WO 2014/128200 | A2 | 8/2014 |

*Primary Examiner* — David H Banh
(74) *Attorney, Agent, or Firm* — BakerHostetler

(57) ABSTRACT

A can imprinting device includes a blanket wheel having a plurality of blankets. Each blanket has a printing surface and at least two of the printing surfaces having a first part and a second part that each have raised and recessed portions. The first raised portion is configured to form a positive image on a can body of the plurality of can bodies. The first raised portion of at least one of the blankets is different in form from the first raised portion of at least one other of the blankets. The second recessed portion is configured to form a negative image on the can body. The negative image is inverse to the positive image. The first part and the second part are disposed relative to each other such that the negative image aligns with the positive image on the can body.

20 Claims, 9 Drawing Sheets

(51) Int. Cl.
*B41C 1/05* (2006.01)
*B65D 1/12* (2006.01)

(56) References Cited

U.S. PATENT DOCUMENTS

2002/0189470 A1* 12/2002 Holm ..... B41F 7/04
101/375
2010/0229737 A1* 9/2010 Ouchi ..... B21D 51/26
101/4
2010/0257819 A1* 10/2010 Schach ..... B41J 3/4073
53/411
2012/0272846 A1* 11/2012 Fleischer ..... B41F 17/22
101/38.1
2015/0128821 A1 5/2015 Vella
2015/0290923 A1* 10/2015 Treloar ..... B41F 3/54
101/217
2016/0001546 A1* 1/2016 Hughes ..... B41F 17/22
101/38.1

* cited by examiner

CAN IMPRINTING DEVICE AND ASSOCIATED METHODS

CROSS-REFERENCE TO RELATED APPLICATIONS

This application claims the benefit of and priority to U.S. provisional application No. 62/398,933, filed Sep. 23, 2016, the disclosure of which is incorporated herein by reference in its entirety.

TECHNICAL FIELD

This disclosure relates generally to a can imprinting device, and more particularly to a can imprinting device configured to print variable images and associated methods thereof.

BACKGROUND

Beverage and other canning companies are interested in providing their customers with cans that have some degree of design differentiation. For example, in a store setting, a consumer may choose between a group of beverage cans that each contain an identical product, but have different images imprinted on each can, such as different phrases, names, or images. An efficient way to provide this design differentiation at the point of consumer purchase is to provide the design differentiation early in the supply chain, at the can decoration stage.

While known can decorators are extremely efficient at producing cans that have a common design, these known decorators are not capable of producing cans with design differentiation using a single blanket wheel during one production run. It is possible to have several blanket wheels that are each configured to produce different designs and then mixing the cans together after decoration during palleting. But such mixing of different production lines adds a degree of complexity to operation that hinders efficiency. By modifying each blanket on the blanket wheel to include raised and recessed portions that are different from other blankets on the same wheel, a single blanket wheel is capable of decorating cans with as many different designs as the wheel has blankets.

SUMMARY

While design differentiation using raised and recessed portions of blankets is known, the inventors of the present application are unaware of any can imprinting devices that are capable of providing close-fitting two-color variable images in a commercial-speed environment. The term "variable image" refers to an image, such as a name or phrase, that is formed on a can body that is different from images formed on other can bodies using the same blanket wheel. A "close-fitting" two-color variable image may include, for example a word or phrase in a first color and a background directly proximate (i.e., touching, nearly touching, or slightly overlapping) the contours of the letters of the word of phrase in a second color. Alternatively, a close-fitting two-color variable image may include a shape in a first color that is directly proximate a background in a second color. Providing close-fitting two-color variable images was previously though impossible because known variable image systems rely on recessing a portion of the blanket to form the variable image on the blanket. Because the blanket is recessed to form the variable image, the blanket does not have a place where the second color can be disposed directly proximate to the variable image to form a close-fitting two-color variable image. In other words, it is the exact structure of known variable image can imprinting devices that prevents close-fitting of two-color variable images.

The inventors of the present disclosure discovered that blankets of known can imprinting devices could be modified to form a positive image in a first color and a negative image that is the inverse of the positive image in a second color. The positive and negative images are then aligned on the can by imprinting the positive image, rotating the can body around, and then imprinting the negative image so as to form the variable image with two close-fitting colors.

In a first aspect of the present disclosure, a can imprinting device is configured to dispose ink on a plurality of can bodies. The can imprinting device includes a blanket wheel having a plurality of blanket segments and a plurality of blankets. Each blanket is affixed to one of the plurality of blanket segments and each blanket has a printing surface. At least two of the printing surfaces include a first part and a second part. The first part has a first outer surface that defines a first raised portion and a first recessed portion. The first raised portion is configured to form a positive image on a can body of the plurality of can bodies. The first raised portion of at least one of the blankets is different in form from the first raised portion of at least one other of the blankets. The second part has a second outer surface that defines a second raised portion and a second recessed portion. The second recessed portion is configured to form a negative image on the can body. The negative image is inverse to the positive image. The first part and the second part are disposed relative to each other such that the negative image aligns with the positive image on the can body. The can imprinting device further includes a first ink station that has a first printing plate configured to contact the first part of each blanket. The can imprinting device also has a second ink station that has a second printing plate configured to contact the second part of each blanket.

In a second aspect of the present disclosure, a method of disposing ink on a plurality of can bodies using a can imprinting device includes a step of rotating a blanket wheel that includes a plurality of blanket segments and a plurality of blankets. Each blanket is affixed to one of the plurality of blanket segments and each blanket has a printing surface. The method also includes a step of disposing a first ink onto a first part of a first printing surface, the first part having a first outer surface that defines a first raised portion and a first recessed portion. The method also includes a step of disposing a second ink onto a second part of the first printing surface, the second part having a second outer surface that defines a second raised portion and a second recessed portion. Additionally, the method includes a step of contacting a first can body of the plurality of can bodies with the first printing surface. The step of contacting the first can body results in forming a first positive image on the first can body with the first raised portion of the first printing surface and forming a first negative image on the first can body with the second recessed portion of the first printing surface. The first negative image is inverse to the first positive image and the first negative image is formed so as to align with the first positive image. The method also includes a step of disposing the first ink onto a first part of a second printing surface, the first part having a first outer surface that defines a first raised portion and a first recessed portion. The method also includes the step of disposing the second ink onto a second part of the second printing surface, the second part having a second outer surface that defines a second raised portion and a second recessed portion. Additionally, the method includes a step of contacting a second can body of the plurality of can bodies with the second printing surface. The step of contacting the second can body results in forming a second positive image on the second can body with the first raised portion of the second printing surface. The second positive image is different in form from the first positive image. The step of contacting the second can body also results in forming a second negative image on the second can body with the second recessed portion of the second printing surface. The second negative image is inverse to the second positive image and the second negative image is formed so as to align with the first positive image.

BRIEF DESCRIPTION OF THE DRAWINGS

The foregoing summary, as well as the following detailed description of illustrative embodiments of the can imprinting device and associated methods of the present application, will be better understood when read in conjunction with the appended drawings. For the purposes of illustrating the can imprinting device and associated methods of the present application, there is shown in the drawings illustrative embodiments. It should be understood, however, that the application is not limited to the precise arrangements and instrumentalities shown. In the drawings.

DETAILED DESCRIPTION OF THE ILLUSTRATIVE EMBODIMENTS

Aspects of the disclosure will now be described in detail with reference to the drawings, wherein like reference numbers refer to like elements throughout, unless specified otherwise. Certain terminology is used in the following description for convenience only and is not limiting.

Figure 1:
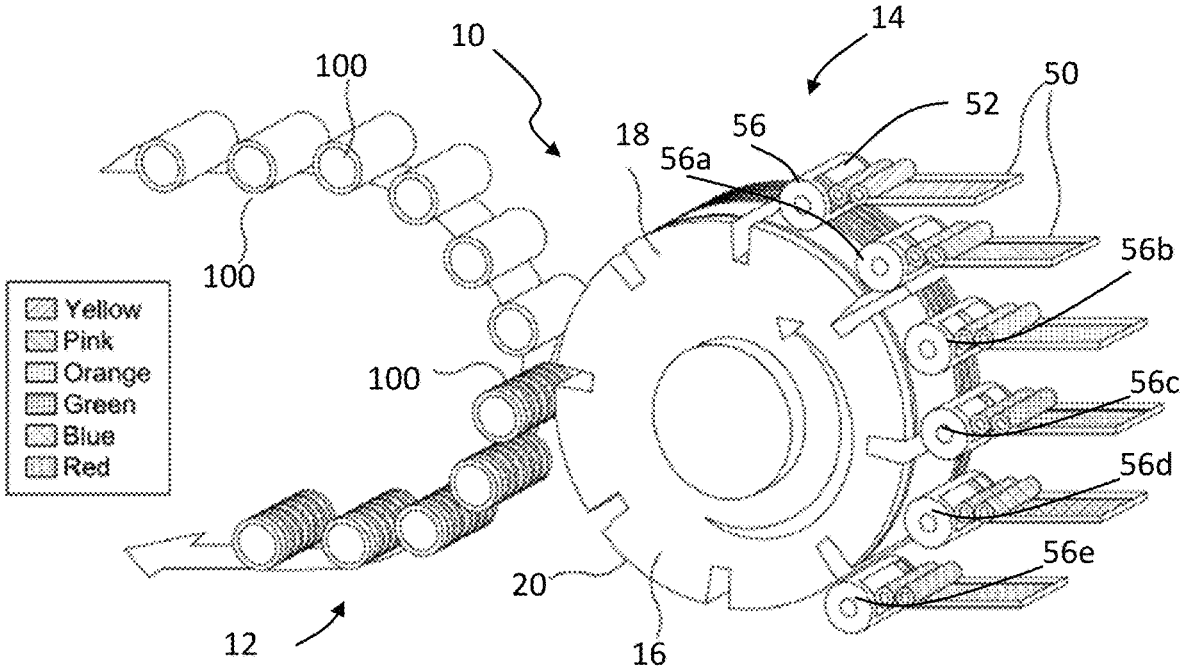
FIG. 1 is a perspective view of a schematic of a can imprinting device that includes a blanket wheel and a feeding mechanism.

Referring to FIG. 1, a can imprinting device 10, or decorator is configured to dispose ink on a plurality of can bodies 100, which preferably are conventional beverage can bodies. The can imprinting device 10 includes a feeding mechanism 12 configured to convey each can body 100 to a printing zone 14 of the can imprinting device 10. The can imprinting device 10 includes a blanket wheel 16 that is disposed in the printing zone 14. The blanket wheel 16 includes a plurality of blanket segments 18 that extend radially about the blanket wheel 16. The blanket wheel 16 further comprises a plurality of blankets 20. Each blanket 20 is affixed to one of the blanket segments 18. Ink is disposed on each blanket 20 using ink stations 50.

Figure 2A:
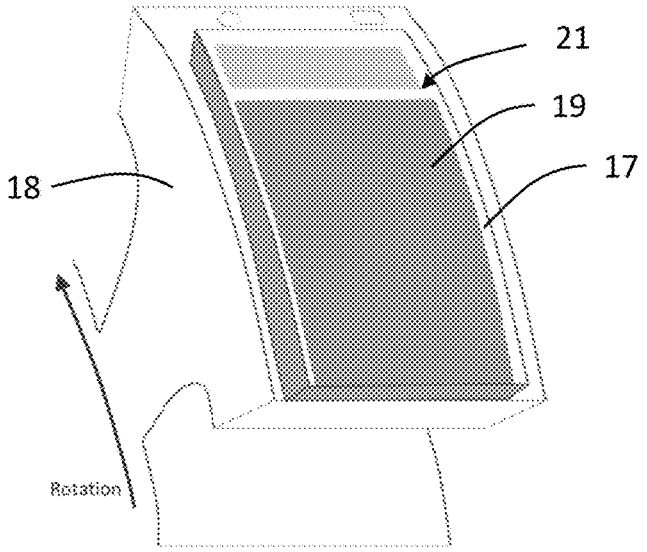
FIG. 2A (Prior Art)
FIG. 2A is a perspective view of a schematic of a portion of a can imprinting device that includes a blanket segment of a blanket wheel and a blanket disposed thereon known in the prior art.
Figure 2B:
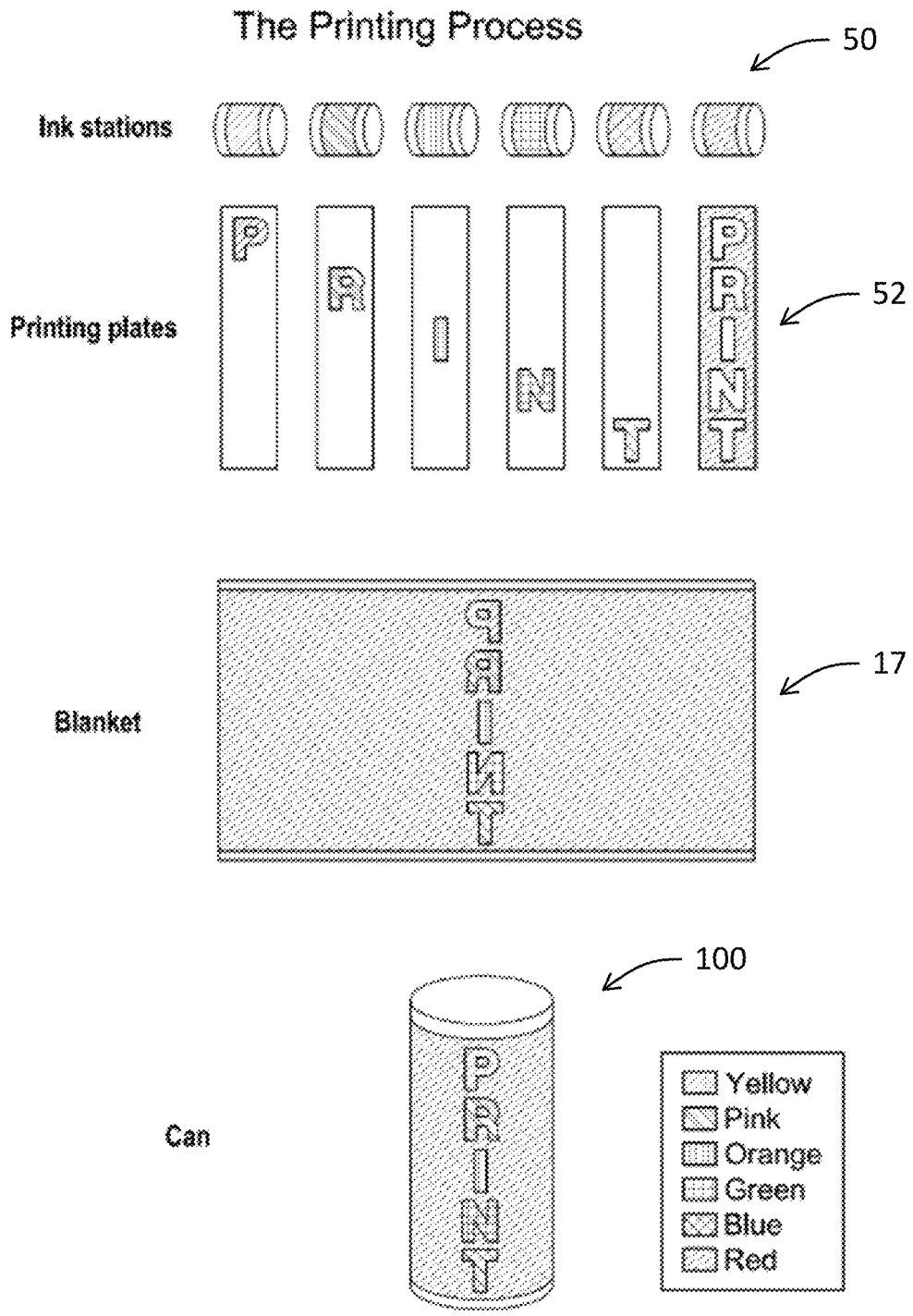
FIG. 2B (Prior Art)
FIG. 2B includes schematics of portions of a can imprinting device including printing plates and a blanket, as well as a can that is decorated using the printing plates and blanket that are known in the prior art.

Ink is disposed on blankets 20 in a similar way to how ink is disposed on prior art blankets 17, shown in FIGS. 2A and 2B. Prior art blanket 17 has a smooth printing surface 19. Each ink station 50 includes a printing plate 52 that may be configured to contact each blanket 17, 20. In relation to FIG. 2B, some or all of ink stations 50 may be configured to dispose ink onto a printing surface 19 of a blanket 17 in the form of positive or negative images that will then be disposed on a can body. As shown, each ink station 50 and printing plate 52 is configured to impart ink in the form of a positive image, such as mirror image of a letter, such as "P", "R", "I", "N", or "T" onto the a blanket 17. Another ink station 50 and printing plate 52 is configured to impart ink in the form of a negative image, such as a mirror image of a background in which the letters "P", "R", "I", "N", and "T" are un-inked images. The blanket 17 then transfers the positive and negative images onto the can 100 so as to form a can that has a background in a first color and lettering in various other colors that are different from the first color. Because each printing plate 52 provides the same image to each blanket 17, and because, as shown in FIG. 2A, blanket 17 has a smooth surface, each prior art blanket 17 decorates a can body 100 with the same design as every other blanket 20 of the blanket wheel 16. This configuration of ink stations 50 and blankets 20 is highly efficient at printing multiple cans with the same decoration, but it cannot print multiple cans that each have different decoration.

In order to impart different decoration to multiple cans at the same time using a single blanket wheel 16, blankets 20, which each have a smooth surface in machines that decorate cans at high speed, may be modified to include raised and recessed portions that together define positive and negative images that may be printed on the can bodies 100. In this modified system, one or more of the blankets 20 on the blanket wheel 16 are different from the other blankets so as to impart varied decoration using a single blanket wheel 16. There are, however, limits to known methods of printing variable images using raised and recessed portions. Specifically, as described above, it was previously thought that close-fitting two-color variable images was not possible because the blanket is recessed to form the variable image and the blanket therefore does not have a place where the second color can be disposed next to the variable image to form a close-fitting two-color variable image.

Figure 3A:
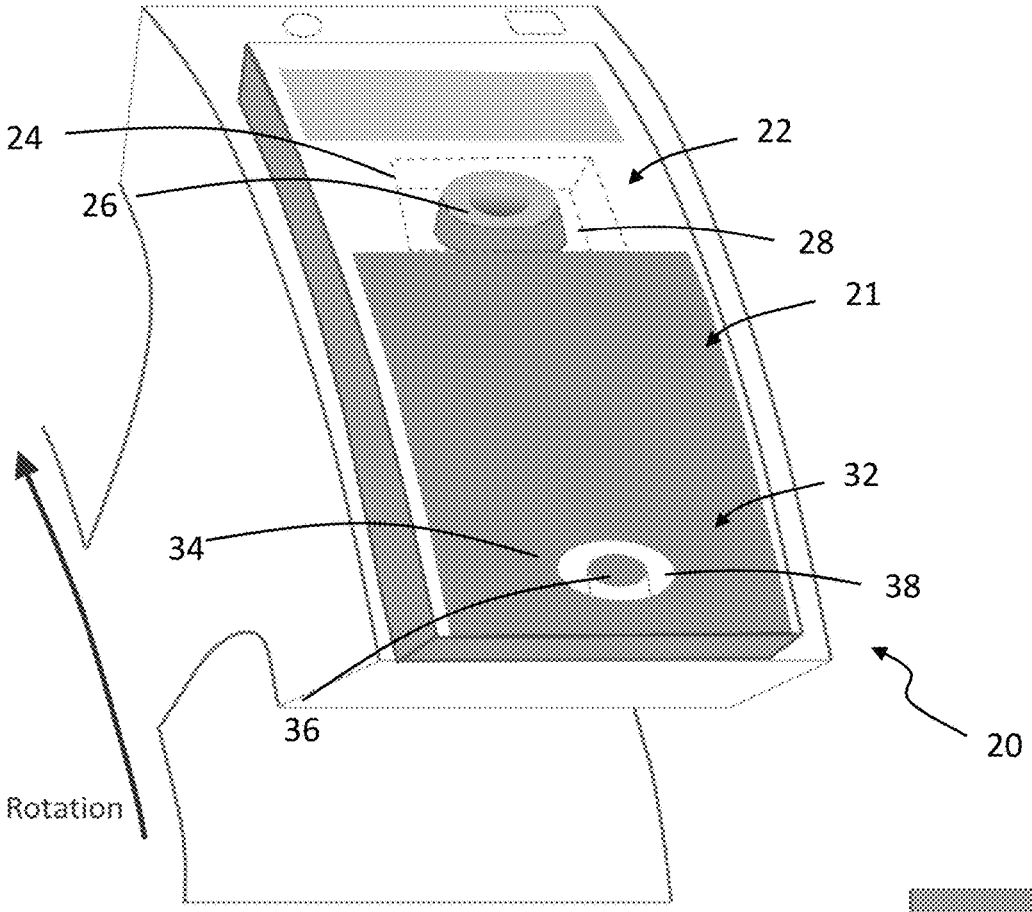
FIG. 3A is a perspective view of a schematic of a portion of a can imprinting device that includes a blanket segment of a blanket wheel and an inventive blanket disposed thereon.
Figure 3C:
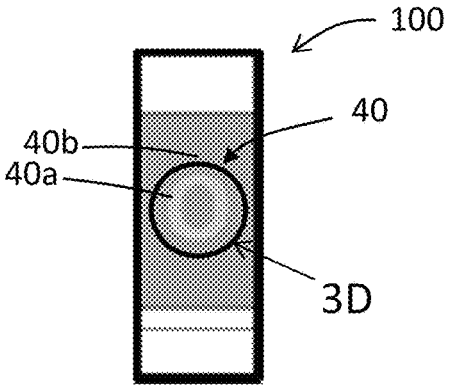
FIG. 3C is a schematic of a can body that has been decorated using the blanket shown in FIG. 3A.
Figure 3D:
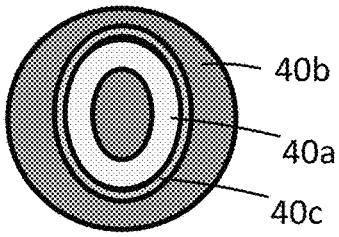
FIG. 3D is an enlarged version of a portion of the can body shown in FIG. 3C schematically depicting overlap of two colors.
Figure 3B:
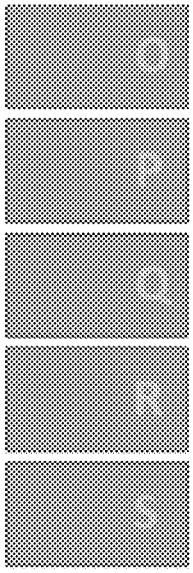
FIG. 3B is a schematic of different decorations that may be applied to a can body using the blanket shown in FIG. 3A or a similarly configured blanket.

The blankets described herein are capable of producing close-fitting two-color variable images. With reference to FIGS. 3A, 3B, and 3C, each blanket 20 may be formed with raised and recessed portions that are inverse of each other. During the imprinting process, the can body 100 is rotated relative to the blanket 20 such that a portion of the can body contacts the blanket 20 twice and the blanket 20 and can body 100 are configured such that the inverse portions align with each other to form the close-fitting two-color variable image 40 (shown in FIG. 3C) that includes positive image 40*a* and negative image 40*b*. The term "align," as used herein corresponds to the term "close-fitting" in that to align the positive image and the negative image results in two colors touching exactly touching (such that no substrate is shown between the colors), nearly touching (such that a small portion of substrate is shown between at least a portion of the borders of both colors), or overlapping (such that the second printed color has a portion that is disposed on top of the first printed color).

For example, with reference to FIG. 3B, each blanket 20 is configured to impart positive and negative images of different letters or series of letters. In one embodiment, each blanket on a blanket wheel 16 is configured to impart positive and negative images of names (e.g. "Jack", "Emma", "Beth", "Henry", etc.). As each can contacts each differently configured blanket, a different name is first disposed as a positive image in a first color, and then that name is again disposed as a negative image in a second color that aligns with the positive image so as a close-fitting, two-color image.

To form the positive image 40*a*, the printing surface 21 of the blanket 20 includes a first part 22 having a first outer surface 24. The first outer surface 24 defines a first raised portion 26 and a first recessed portion 28. The term "raised" as used herein refers to a portion of the blanket that is raised relative to a recessed portion of the blanket. Correspondingly, the term "recessed" as used herein refers to a portion of the blanket that is recessed relative to a raised portion of the blanket. For example, a blanket, such as blanket 17 described above as having a smooth printing surface may be etched to form recessed portions. The remaining portions that have the original thickness of the blanket 17 are raised portions. The first raised portion 26 is configured to form the positive image 40*a* (in this case the letter "0") on a can body 100. As shown in FIG. 3B, the first raised portion 26 of the blanket 20 is different in form from the first raised portion 26 of at least one other of the blankets (in this case, the other blankets form the positive image 40*a* of the letters "P", "Q", "R", or "S").

Figure 4A:
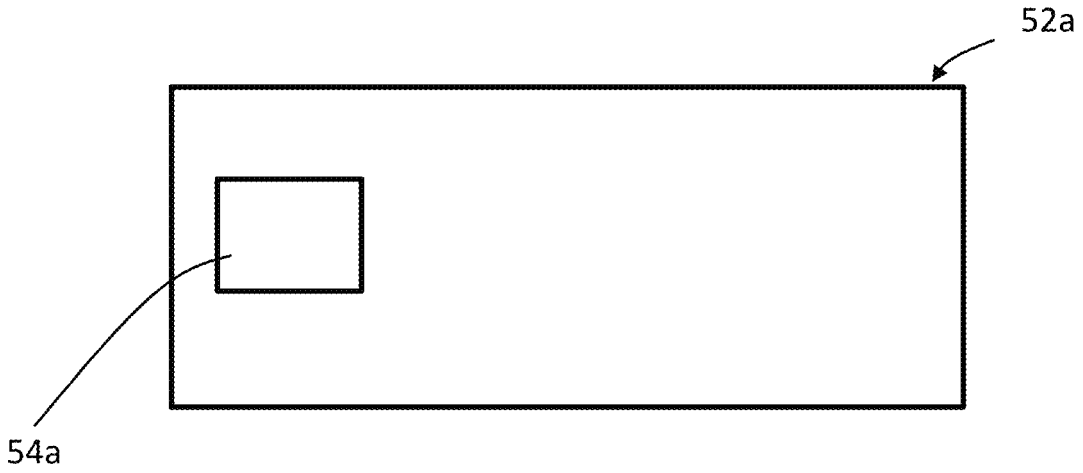
FIGS. 4A, 4B, 4C, and 4D are top and side views of schematics of printing plates that may be used to dispose ink on the blanket shown in FIG. 3A.
Figure 4B:
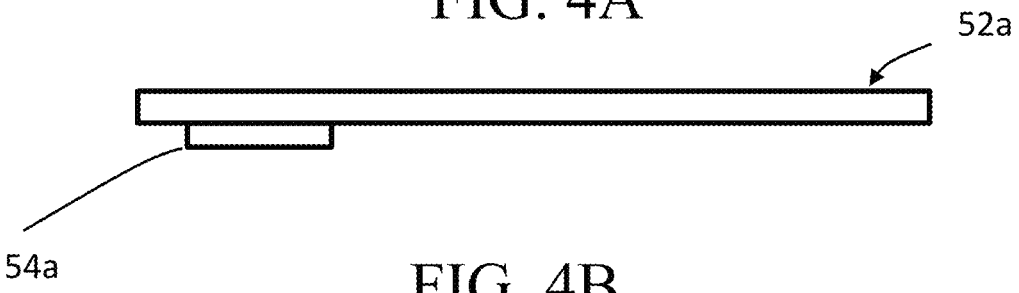

With reference to FIGS. 4A and 4B, ink may be disposed on the first raised portion 26 using a printing plate 52*a* that includes a projection 54*a* that contacts first raised portion 26. FIGS. 4A and 4B are top and side views of the printing plate that is configured to be wrapped around a cylinder 56*a* of the ink station 50 (shown in FIG. 1). The cylinder 56*a* of the ink station 50 and the blanket wheel 16 are configured to rotate at a speed relative to one another such that projection 54*a* contacts first raised portion 26 as the blanket 20 rotates proximate ink station 50.

With reference again to FIGS. 3A and 3B, to form the negative image 40*b*, the printing surface 21 of the blanket 20 includes a second part 32 having a second outer surface 34. The second outer surface 34 defines a second raised portion 36 and a second recessed portion 38. The second recessed portion 38 is configured to form the negative image 40*b* on the can body that corresponds to and is the inverse of the positive image 40*a* described above (in this case an inverse of the letter "O") on a can body 100. As shown in FIG. 4B, the second recessed portion 38 of the blanket 20 is different in form from the second recessed portion 38 of at least one other of the blankets (in this case, the other blankets form the negative image of the letters "P", "Q", "R", or "S"). The second raised portion 36 and the second recessed portion 38 are disposed relative to the first raised portion 26 and the first recessed portion 28 such that the negative image 40*b* aligns with the positive image 40*a* on the can body 100 to form a close-fitting, two-color image (for example, an image of letters "O", "P", "Q", "R", or "S").

Figure 4C:
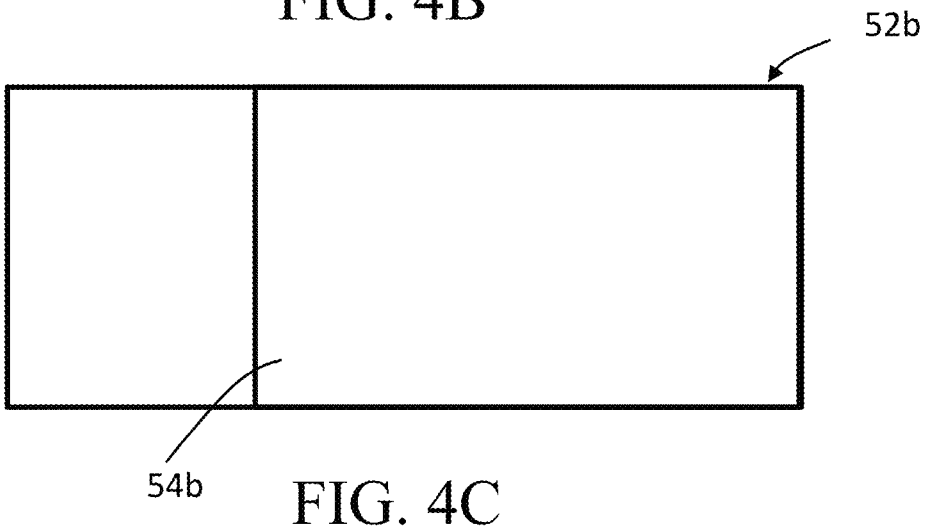
Figure 4D:
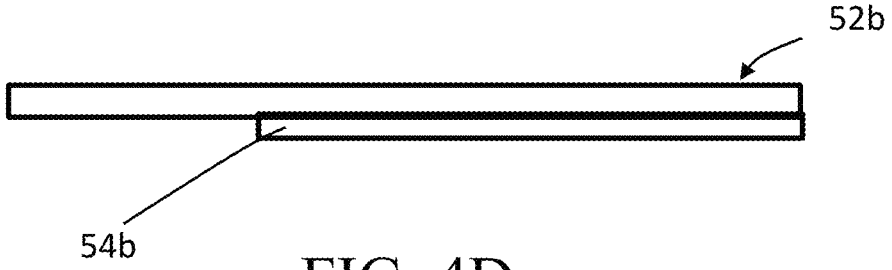

With reference to FIGS. 4C and 4D, ink may be disposed on the second raised portion 36 using a printing plate 52*b* that includes a projection 54*b* that contacts second raised portion 36. FIGS. 4C and 4D are top and side views of the printing plate that is configured to be wrapped around a cylinder 56*b* of the ink station 50 (shown in FIG. 1). The cylinder 56*b* of the ink station 50 and the blanket wheel 16 are configured to rotate at a speed relative to one another such that projection 54*b* contacts second raised portion 36 as the blanket 20 rotates proximate ink station 50. Second recessed portion 38 does not contact projection 54*b* such that no ink is disposed in the area of second recessed portion 38 and the negative image 40*b* is formed by the absence of ink disposed on the can body 100.

After projections 54*a* and 54*b* contact the blanket 20, blanket 20 carries at least two colors of ink. Can body 100 then rotates relative to the blanket 20 so as to first pick up the positive image 40*a* (in this case "O"). Can body 100 then continues to rotate to pick up the second color. As can body 100 continues to rotate, can body 100 picks up the negative image 40*b* (in this case the inverse of "O"). The negative image 40*b* is formed around the previously formed positive image 40*a*. With reference to FIG. 3D, positive image 40*a* and negative image 40*b* may be aligned relative to one another such that the color of the negative image (which is printed on the can second) is disposed on top of the color of the positive image (which is printed on the can first). In other embodiments, where the negative image is printed first, the positive image overlaps the negative image. By disposing the color of the negative image 40*b* on top of the color of the positive image 40*a*, the two colors may blend or partially blend on the can body 100 in a border area 40*c*. For example, if the positive image 40*a* is yellow, and the negative image 40*b* is blue, the overlapping of images 40*a*, 40*b* may result in a green border around the yellow positive image 40*a*. Alternatively, the overlapping of images 40*a*, 40*b* may result in a border comprised of yellow and blue swirls.

As shown in FIG. 4B, each blanket 20 on the blanket wheel 16 may have a different design. For example, some or all of the blankets may include the corresponding raised portions 26, 36 and recessed portions 28, 38. At least one of the blankets 20 may have a constant thickness with no raised or recessed portions 26, 28, 36, 38. Each blanket 20 may be different from some or all of the blankets 20 disposed on the blanket wheel 16. For example, blanket wheel 16 includes eight blanket segments 18 that together carry eight blankets 20. Blanket wheel 16 may carry up to the number of differentiated designs as it has blankets 20 (in this case eight). Blanket wheel 16 may carry a number of differentiated designs that is less than its number of blankets 20 in the case that two or more of the blankets 20 share a design.

The raised and recessed portions of each blanket 20 may be formed by methods including etching, such as laser etching. Specifically, the recessed portions may be etched by removing some, or all, of the blanket 20 to form the recessed portions 28, 38. The raised portions 26, 36 are then formed by what is left of the blanket 20 such that the raised portions 26, 36 have, for example, a thickness of the blanket before etching. The raised and recessed portions may also be formed by cutting through a single thin layer of the blanket 20 to form the recessed portions 28, 38 by the portions of the blanket 20 that are removed. The raised portions 26, 36 are the portions that are not removed. The single thin layer may then be disposed on a blanket backing that attaches to the blanket segment 18. Using a blanket backing with a single thin layer enables the backing to remain attached to the blanket segment for a prolonged period with only the top layer being removed and attached more frequently.

Laser etching to form the raised and recessed portions of the blankets 20 may be used to produce high-definition, photo-quality images on the can bodies 100. For example, laser etching may be able to produce a half-tone effect on the can body 100. Color blending, such as the color blending described above in relation to images that are aligned to overlap, may also be employed to enhance image quality.

Raised and recessed portions of each blanket 20 may also be formed by other means including using a plate made of a photo-curable material, such as a UV-curable material or material cured by light of a different wavelength. The blanket 20 may include elastomers which are cured using a light-catalyzed photopolymerization process. The blanket 20 may alternatively include chloroprene cross-linked with trimethylolpropane triacrylate. Alternatively still, the blanket may include styrene-isoprene rubber with a polyacrylate, or another light-curable material known at the time of filing or later developed. These materials may be used to facilitate high-definition, photo-quality images on the can bodies 100 using raised and recessed portions of the blankets.

Figure 5A:
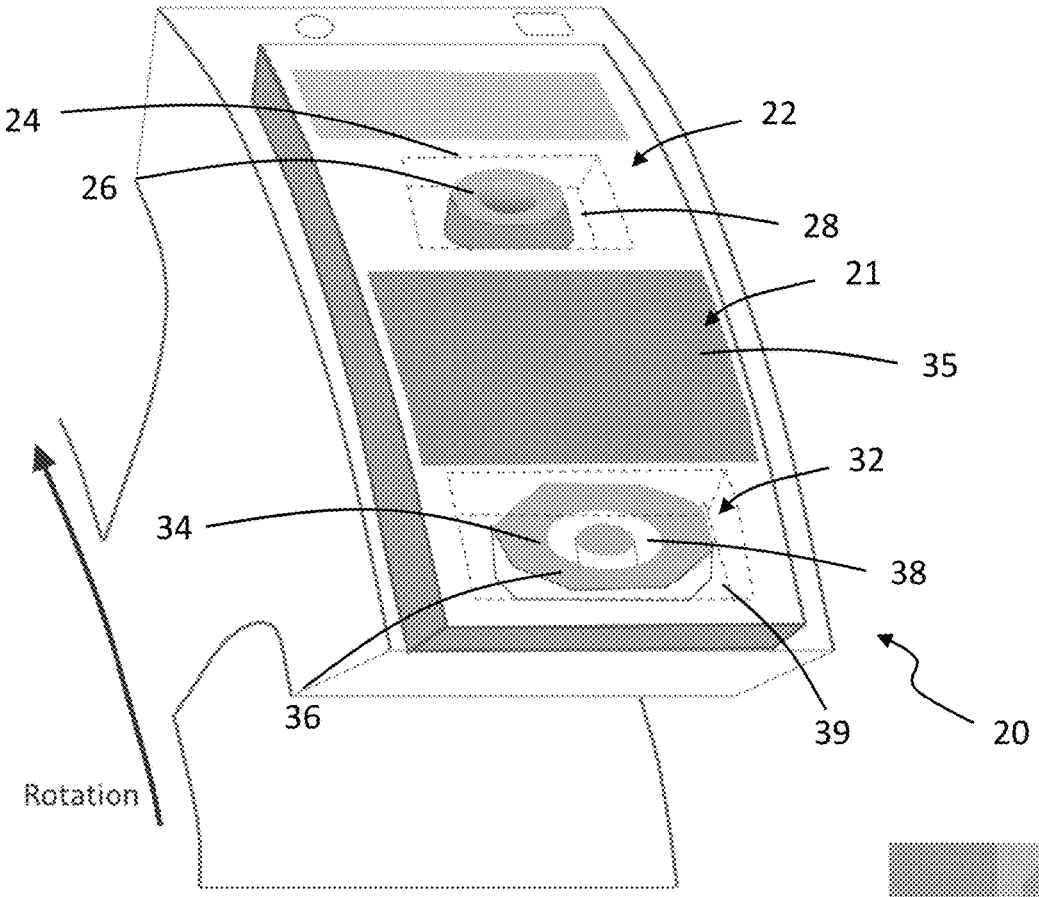
FIG. 5A is a perspective view of a schematic of a portion of a can imprinting device that includes a blanket segment of a blanket wheel and an inventive blanket disposed thereon.
Figure 5C:
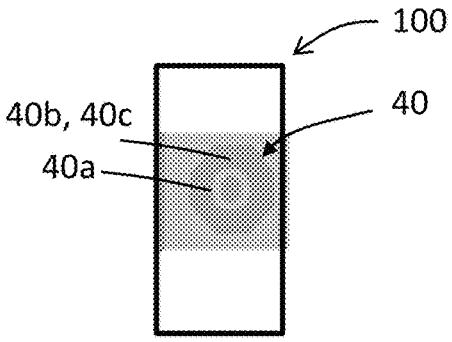
FIG. 5C is a schematic of a can body that has been decorated using the blanket shown in FIG. 5A.
Figure 5B:
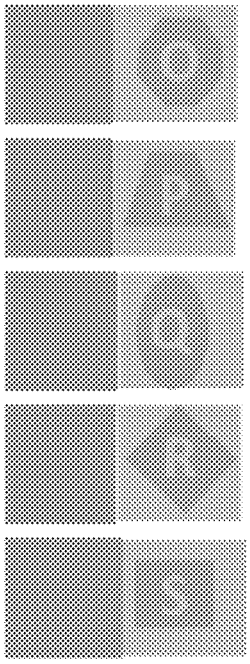
FIG. 5B is a schematic of different decorations that may be applied to a can body using the blanket shown in FIG. 5A or a similarly configured blanket.

With reference now to FIGS. 5A, 5B and 5C, the printing surface 21 of each blanket 20 may be further configured to form a second positive image 40*c* within which the negative image 40*b* is disposed. Specifically, as described in detail above, the blanket 20 shown in FIG. 5A includes first part 22 which has first outer surface 24 which in turn defines the first raised portion 26 that forms the first positive image 40*a* (e.g. the letter "O") and the first recessed portion 28. As also described above, blanket 20 includes second part 32 which has second outer surface 34 which in turn defines the second raised portion 36 and the second recessed portion 38 that forms the negative image 40*b* (e.g. the inverse of the letter "O"). In FIG. 5A, second outer surface 34 further defines a third recessed portion 39 that forms the second positive image 40*c* (in this case, a hexagon within which the inverse of the letter "O") is disposed.

As shown in FIG. 5B, the third recessed portion 39 of the blanket 20 is different in form from the third recessed portion 39 of at least one other of the blankets (in this case, the other blankets form the positive image of the a trapezoid, an oval, a rectangle and a square). Blankets 20 may be configured such that each blanket has a different first positive image 40*a* and a different second positive image 40*c*, or such that one or both of the first positive image 40*a* and the second positive image 40*c* are the same as either or both of the first positive image 40*a* and the second positive image 40*c* formed by another blanket 20 on the blanket wheel 16.

Figure 6A:
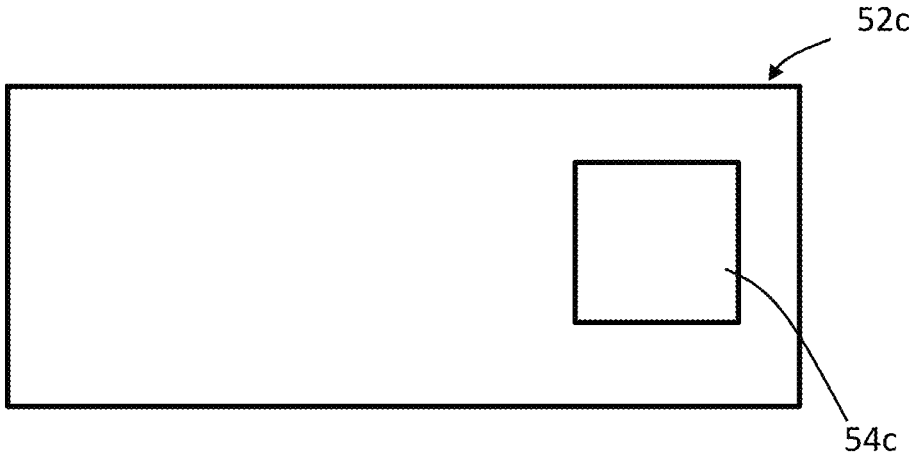
FIGS. 6A, 6B, 6C, and 6D are top and side views of schematics of printing plates that may be used to dispose ink on the blanket shown in FIG. 5A.
Figure 6B:
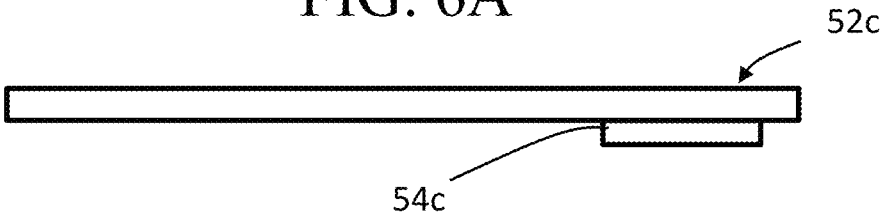

With reference to FIGS. 6A and 6B, instead of disposing ink on the second raised portion 36 using plate 52*b* and projection 54*b*, ink may instead be disposed on the second raised portion 36 using a printing plate 52*c* that includes a projection 54*c* so that a third color ink may be disposed on the can body 100. FIGS. 6A and 6B are top and side views of the printing plate that is configured to be wrapped around a cylinder 56*c* of the ink station 50 (shown in FIG. 1). The cylinder 56*c* of the ink station 50 and the blanket wheel 16 are configured to rotate at a speed relative to one another such that projection 54*c* contacts second raised portion 36 as the blanket 20 rotates proximate ink station 50. The third recessed portion 39 enables ink to be selectively disposed only on the portion of the second part 32 that forms the second positive image 40*c* and negative image 40*b*. Again, second recessed portion 38 does not contact projection 54*c* such that no ink is disposed in the area of second recessed portion 38 and the negative image is formed by the absence of ink disposed on the can body 100.

Figure 6C:
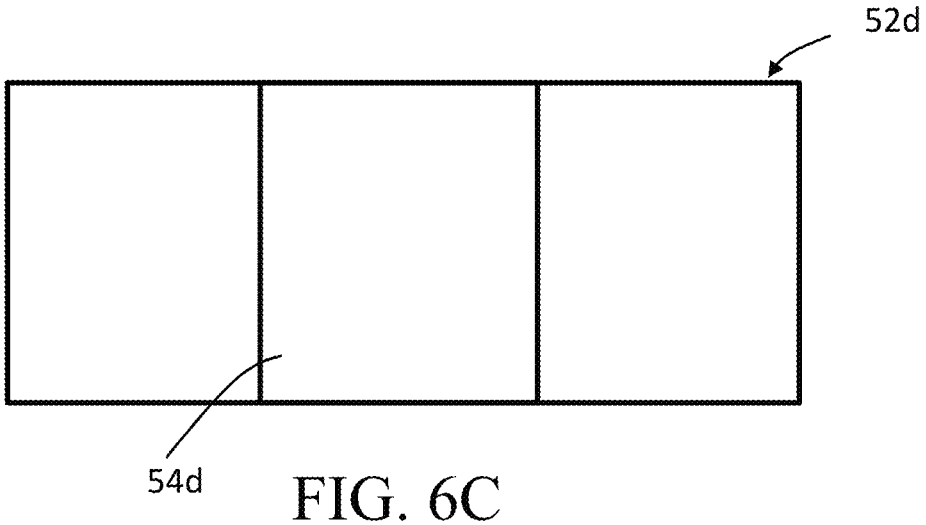
Figure 6D:
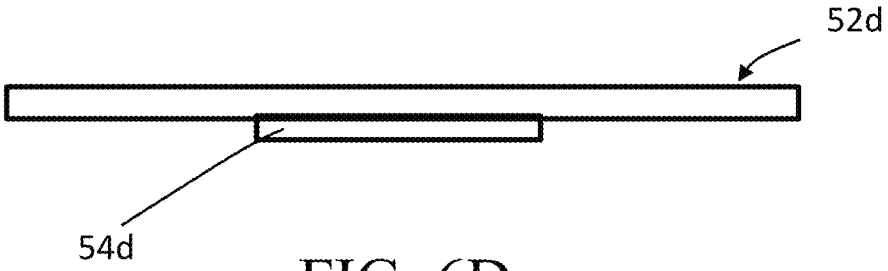

A middle portion 35 of the blanket 20 is inked using a printing plate 52*d* that is similar to printing plate 52*b*, but with a portion of its projection 54*d* truncated so as not to ink second raised portion 36. Specifically, FIGS. 6C and 6C are top and side views of printing plate 52*d* that is configured to be wrapped around a cylinder 56*d* of the ink station (shown in FIG. 1). The cylinder 56*d* of the ink station 50 and the blanket wheel 16 are configured to rotate at a speed relative to one another such that projection 54*d* contacts the middle portion 35 as the blanket 20 rotates proximate ink station 50.

Figure 7A:
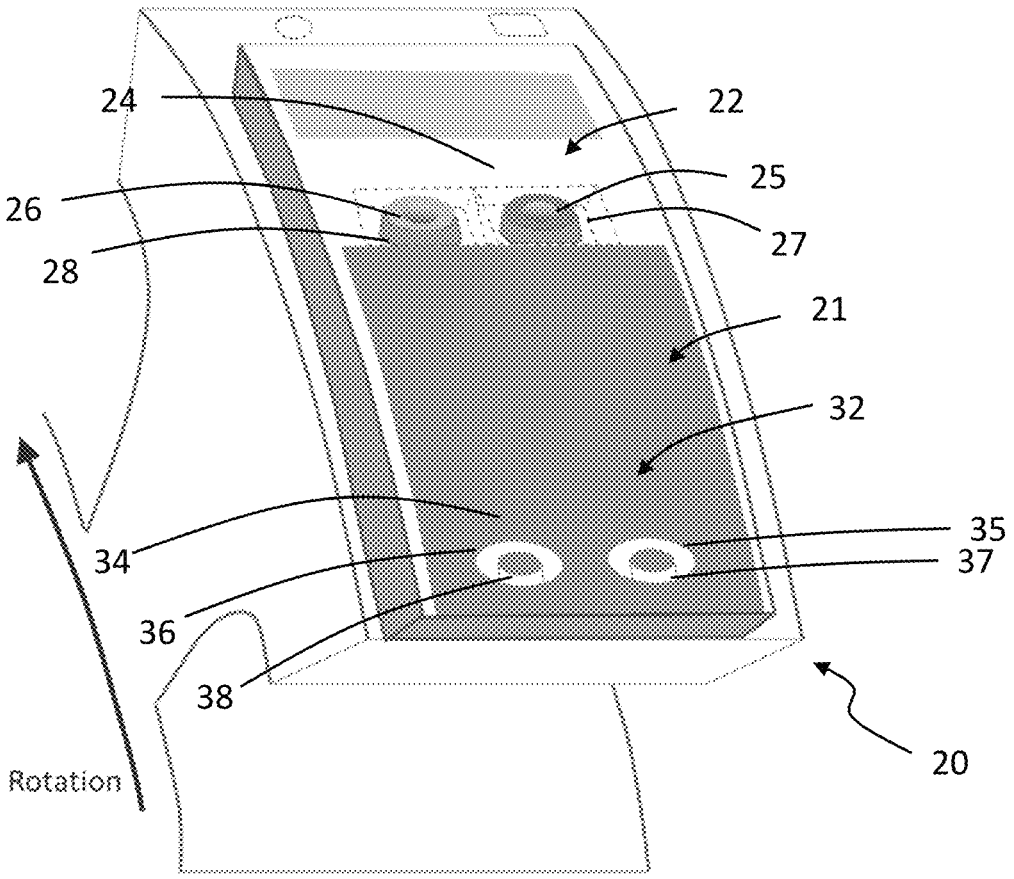
FIG. 7A is a perspective view of a schematic of a portion of a can imprinting device that includes a blanket segment of a blanket wheel and an inventive blanket disposed thereon.
Figure 7C:
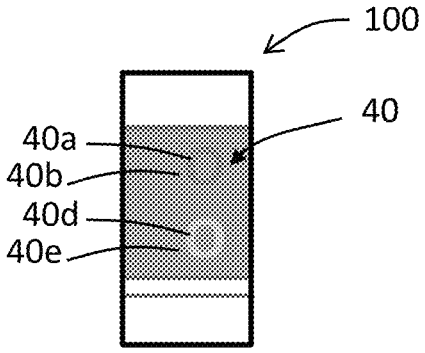
FIG. 7C is a schematic of a can body that has been decorated using the blanket shown in FIG. 7A.
Figure 7B:
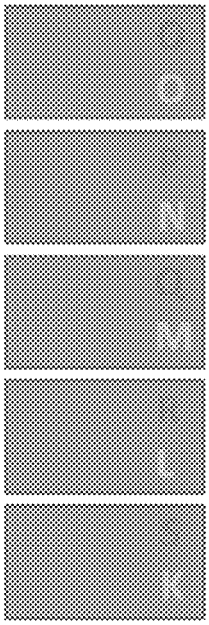
FIG. 7B is a schematic of different decorations that may be applied to a can body using the blanket shown in FIG. 7A or a similarly configured blanket.

Referring now to FIGS. 7A, 7B, and 7C, multiple positive and corresponding negative images may be formed using raised and recessed portions of the printing surface 21 of blanket 20. As described in detail above, the blanket 20 shown in FIG. 7A includes first part 22 which has first outer surface 24 which in turn defines the first raised portion 26 that forms the first positive image 40*a* (e.g. the first letter "O") and the first recessed portion 28. First outer surface 24 also defines a third raised portion 25 that forms the second positive image 40*d* (e.g. the second letter "O") and the second recessed portion 27. As also described above, blanket 20 includes second part 32 which has second outer surface 34 which in turn defines the second raised portion 36 and the second recessed portion 38 that forms the negative image 40*b* (e.g. the inverse of the first letter "O"). Second outer surface 34 also defines a third raised portion 35 that forms the second negative image 40*e* (e.g. the inverse of the second letter "O") and the second recessed portion 37.

As shown in FIG. 7B, each blanket 20 may have a first positive image 40*a* that is different from or the same as the second positive image 40*d*. The first positive image 40*a* on each blanket 20 on the blanket wheel 16 may be different from or the same as the first positive image 40*a* on the other blankets 20 on the blanket wheel 16. The second positive image 40*d* on each blanket 20 on the blanket wheel 16 may be different from or the same as the second positive image 40*d* on the other blankets 20 on the blanket wheel 16.

As described above, plate 52*a* and projection 54*a* may be used to dispose ink on the first raised portion 26 and the third raised portion 25 if the same color is desired for the first positive image 40*a* and the second positive image 40*d*. In order for the first positive image 40*a* and the second positive image 40*d* to have different colors, with reference to FIGS.

Figure 8A:
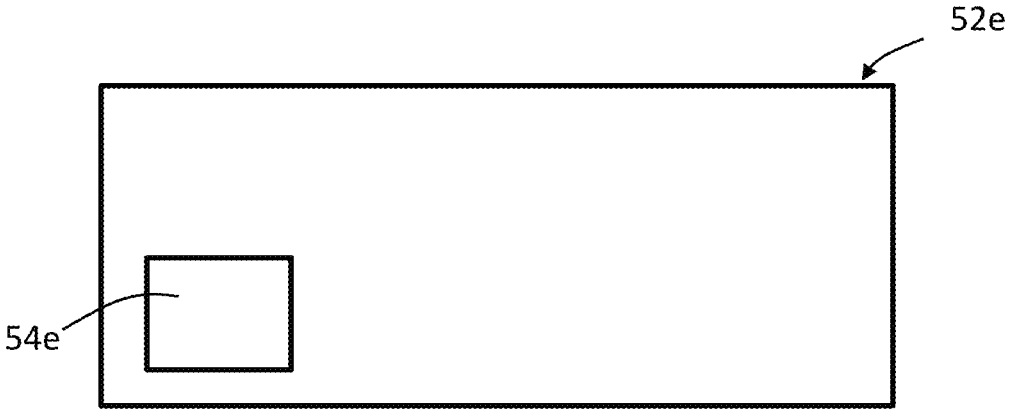
FIGS. 8A, 8B, 8C, and 8D are top and side views of schematics of printing plates that may be used to dispose ink on the blanket shown in FIG. 7A.
Figure 8B:
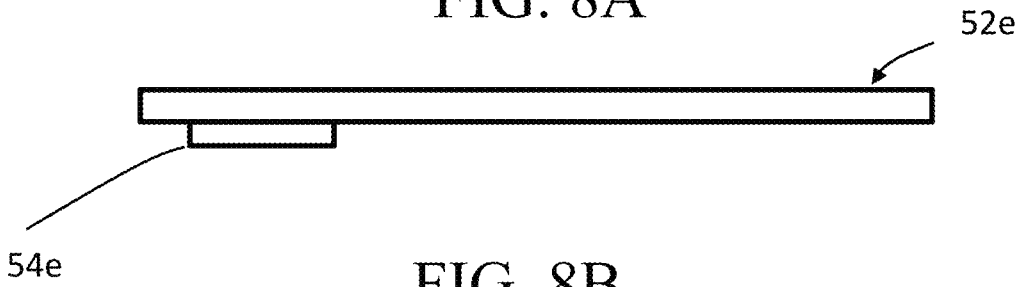
Figure 8C:
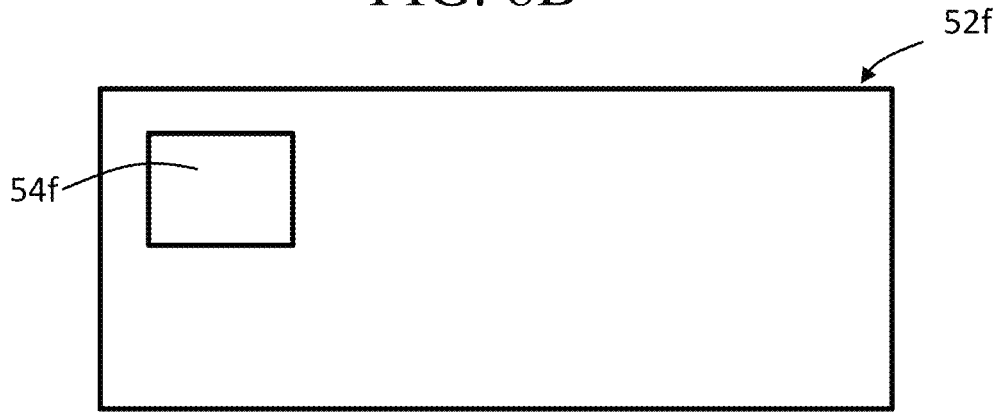
Figure 8D:
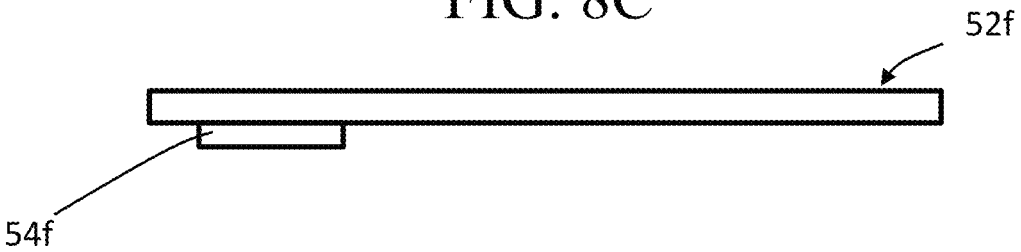

8A, 8B, 8C, and 8D ink may be disposed on the first raised portion 26 and the third raised portion 25 using plates 52*e* and 52*f* so that a third color ink may be disposed on the can body 100. FIGS. 8A and 8B are top and side views of the printing plate 52*a* that is configured to be wrapped around a cylinder 56*e* of the ink station 50 (shown in FIG. 1, note that a single cylinder is used to schematically represent both cylinders 56*e* and 56*f*). The cylinder 56*e* of the ink station 50 and the blanket wheel 16 are configured to rotate at a speed relative to one another such that projection 54*e* contacts first raised portion 26 as the blanket 20 rotates proximate ink station 50. FIGS. 8C and 8D are top and side views of the printing plate 52*f* that is configured to be wrapped around a cylinder 56*f* of the ink station 50. The cylinder 56*f* of the ink station 50 and the blanket wheel 16 are configured to rotate at a speed relative to one another such that projection 54*f* contacts third raised portion 25 as the blanket 20 rotates proximate ink station 50.

With reference again to FIGS. 4C and 4D, ink may be disposed on the second raised portion 36 and third raised portion 35 using a printing plate 52*b* that includes a projection 54*b* that contacts second raised portion 36 and third raised portion 35. The cylinder 56*b* of the ink station 50 and the blanket wheel 16 are configured to rotate at a speed relative to one another such that projection 54*b* contacts second raised portion 36 and third raised portion 35 as the blanket 20 rotates proximate ink station 50. Second recessed portion 38 and third recessed portion 37 do not contact projection 54*b* such that no ink is disposed in the areas of second recessed portion 38 and third recessed portion 37 and the negative images 40*b* and 40*e* are formed by the absence of ink disposed on the can body 100.

Similar to the process described above in relation to FIGS. 3A, 3B, and 3C, after projections 54*e*, 54*f*, and 54*b* contact the blanket 20, blanket 20 carries at least two colors of ink, and at least three colors of ink if plates 54*e* and 54*f* deposit different color ink on the blanket 20. Can body 100 then rotates relative to the blanket 20 so as to first pick up the first positive image 40*a* and the second positive image 40*d*. Can body 100 then continues to rotate to pick up another color. As can body 100 continues to rotate, can body 100 picks up the first negative image 40*b* and the second negative image 40*e*. The first negative image 40*b* is formed around the previously formed first positive image 40*a* and the second negative image 40*e* is formed around the previously formed second positive image 40*d*.

During operation, each blanket 20 on the blanket wheel 16 may have raised and recessed portions according to any of the configurations, or combinations of configurations as described above. For example, a blanket 20 having four or more positive images could be formed using a series of positive images in the first part 22 and a series of corresponding negative images in the second part 32. Moreover, additional positive images may be formed by adding additional recessed portions to the second part 32 similar to the third recessed portion 39 shown in FIG. 5A.

The blanket wheel 16 of the can imprinting device 10 may be rotated as feeding mechanism 12 conveys can bodies to the printing zone 14 so that each can body 100 may be rotated relative to a blanket 20 to impart a design. As can imprinting device 10 is contacting can bodies 100 on one portion of the blanket wheel 16, ink is being disposed on the printing surfaces 21 of the blankets 20 on another portion of the wheel. With reference to FIG. 1, cylinder 56*a* may be rotated to dispose a first ink onto the first raised portion 26 of the first outer surface 24 of the first part 22 of the first printing surface 21 of a first blanket 20. Cylinder 56*b* may also be rotated to dispose a second ink onto the second raised portion 36 of the second outer surface 34 of the second part 32 of the first printing surface 21 of the first blanket 20. Additional ink may be disposed on the first blanket 20 by rotating other cylinders.

After the first printing surface 21 of the first blanket 20 is carrying all of the ink to be used to decorate the first can body 100, the first can body 100 is rotated relative to the first printing surface 21 of the first blanket 20. As the first can body 100 contacts the first printing surface 21, a first positive image 40*a* is formed on the first can body 100 with the first raised portion 26 of the first printing surface 21. Contacting the first can body 100 with the first printing surface 21 also results in forming a first negative image 40*b* on the first can body 100 with the second recessed portion 38 of the first printing surface 21. As described above, the first negative image 40*b* is inverse to the first positive image 40*a* and the first negative image 40*b* is formed so as to align with the first positive image 40*a*.

With reference again to FIG. 1, the same or a different combination of cylinders may be used to ink the second blanket 20. For example, cylinder 56*a* may be rotated to dispose the first ink onto the first raised portion 26 of the first outer surface 24 of the first part 22 of the second printing surface 21 of a second blanket 20. Cylinder 56*b* may also be rotated to dispose a second ink onto the second raised portion 36 of the second outer surface 34 of the second part 32 of the second printing surface 21 of the second blanket 20. Additional ink may be disposed on the second blanket 20 by rotating other cylinders.

After the second printing surface 21 of the second blanket 20 is carrying all of the ink to be used to decorate the second can body 100, the second can body 100 is rotated relative to the second printing surface 21 of the second blanket 20. As the second can body 100 contacts the second printing surface 21, a first positive image 40*a* is formed on the second can body 100 with the first raised portion 26 of the second printing surface 21. The first positive image 40*a* formed on the second can body 100 is different from the first positive image formed on the first can body 100. Contacting the second can body 100 with the second printing surface 21 also results in forming a first negative image 40*b* on the second can body 100 with the second recessed portion 38 of the second printing surface 21. As described above, the first negative image 40*b* is inverse to the first positive image 40*a* and the first negative image 40*b* is formed so as to align with the first positive image 40*a*.

Modification to the method described above may be employed according to the design of the blanket 20 being inked. For example, in addition to the first and second blankets 20 described above, additional blankets 20 that have raised and recessed portions 26, 28, 36, 38 that are different from or the same as each other, and different from or the same as the raised and recessed portions 26, 28, 36, 38 of the first and second blankets 20 may be employed on the other blanket segments 18 of the blanket wheel 16.

Additionally, first and second blankets 20 and other blankets 20 disposed on blanket wheel 16 may include another recessed portion 39 that is configured to form another positive image 40*c* on a can body 100. First and second blankets 20 and other blankets 20 disposed on blanket wheel 16 may also include a raised portion 25 that is configured to form a positive image 40*d*. Positive image 40*d* may be aligned with a corresponding negative image 40*e* on can body 100 that is formed by a recessed portion 37. Raised portions 25, 26 may be inked with different colors or the same color. Additionally, the raised and recessed portions of each blanket 20 may have portions that are the same as or different from other blankets 20 on the blanket wheel 16.

Figure 9:
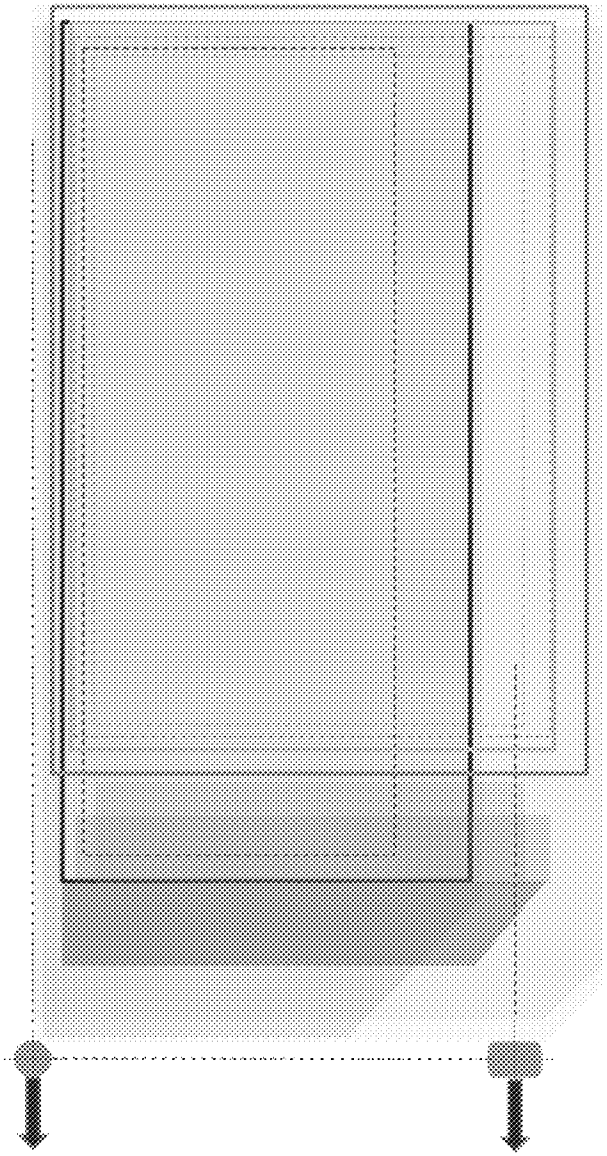
FIG. 9 is a schematic of various blanket outlines on a blanket segment.

With reference to FIG. 9, various blanket outlines are shown schematically on a blanket segment 18. The configurations described above rely on a blanket 20 that has a circumferential length relative to the axis about which the blanket wheel 16 rotates that is longer than the circumferential length that would typically be considered required in order to decorate a can body 100 having a given diameter. For example, blankets that are typically employed to decorate a large diameter can body may be modified and used according to the methods described herein to decorate small diameter can bodies 100 with close-fitting two-color variable images. Specifically, the relatively longer circumferential length of the blankets 20 provide for the can body 100 to have at least a portion of its circumference rotate about twice against the blanket 20. In one example, a blanket 20 that has a circumferential length configured to print a standard can diameter of 63 mm could be used to print cans having smaller diameters, such as 53 or 58 mm. In relation to the blanket 20 shown in FIG. 3A, the first rotation deposits the positive image 40*a* and the second rotation deposits the corresponding negative image 40*b*. Alternatively, the negative image 40*b* could be deposited in advance of the positive image 40*a*.

Additional modifications to blanket wheel 16 and blankets 20 may be made based on the description above to provide further functionality during the decorating process. For example, the portion of the blanket 20 considered to be the "acceleration" zone may be used for printing. Further, a longer blanket 20 could be employed to cover the additional or all of the circumferential length of the blanket segment 18. Blanket wheel 16 and blanket segments 18 may be further modified to support blankets having longer circumferential length. Such modifications could provide for portions of the can body 100 to rotate along the blanket more than twice or for large diameter can bodies to be decorated with close-fitting two-color variable images.

Additional changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the claims.

What is claimed:

1. A can imprinting device configured to dispose ink on a plurality of can bodies, the can imprinting device comprising:

a blanket wheel comprising:

a plurality of blanket segments; and a plurality of blankets, each blanket affixed to one of the plurality of blanket segments and each blanket having a printing surface configured to contact one can body of the plurality of can bodies, at least two of the printing surfaces including:

a first part having a first outer surface, the first outer surface defining a first raised portion and a first recessed portion, the first raised portion configured to form a positive image on a can body of the plurality of can bodies, the first raised portion of one of the at least two blankets being different in form from the first raised portion of another of the at least two blankets; and a second part having a second outer surface, the second outer surface defining a second raised portion and a second recessed portion, the second recessed portion configured to form a negative image on the can body, the negative image being inverse to the positive image, wherein each of the plurality of blankets is configured such that a total length of the first outer surface and the second outer surface of each blanket is greater than a circumferential length of the can body such that the second recessed portion defined by the second outer surface overlaps the first raised portion defined by the first outer surface;

a first ink station, the first ink station comprising a first printing plate configured to contact the first part of each blanket; and a second ink station, the second ink station comprising a second printing plate configured to contact the second part of each blanket.

2. The can imprinting device of claim 1 wherein each of the printing surfaces of the plurality of blankets includes the first outer surface defining the first raised portion and the first recessed portion and the second outer surface defining the second raised portion and the second recessed portion.

3. The can imprinting device of claim 2 wherein the first raised portion of each blanket is different in form from the first raised portion of the other blankets of the plurality of blankets.

4. The can imprinting device of claim 1 wherein the negative image aligns with the positive image on the can body such that a portion of the negative image overlaps a portion of the positive image.

5. The can imprinting device of claim 1 wherein the positive image is a first positive image and the second raised portion and the second recessed portion are configured to form a second positive image within which the negative image is disposed.

6. The can imprinting device of claim 5 wherein the second raised portion of at least one of the plurality of blankets is different in form from the second raised portion of at least one other of the plurality of blankets.

7. The can imprinting device of claim 1 wherein the positive image is a first positive image and the negative image is a first negative image, the first part further comprising a third raised portion and a third recessed portion, the third raised portion being configured to form a second positive image, and the second part further comprising a fourth raised portion and a fourth recessed portion, the fourth recessed portion being configured to form a second negative image, the second negative image being inverse to the second positive image and the first part and the second part being disposed relative to each other such that the second negative image aligns with the second positive image on the can body.

8. The can imprinting device of claim 7 wherein the first printing plate is configured to contact the first raised portion of the first part and the device further comprises a third ink station, the third ink station comprising a third printing plate, wherein the third printing plate is configured to contact the third raised portion.

9. The can imprinting device of claim 8 wherein the first ink station includes a first color ink and the third ink station includes a second color ink in that is different from the first color ink.

10. The can imprinting device of claim 7 wherein for at least one of the blankets, the first raised portion of the at least one of the blankets is different in form from the third raised portion of that blanket.

11. A method of disposing ink on a plurality of can bodies using a can imprinting device, the method comprising:

rotating a blanket wheel, the blanket wheel comprising a plurality of blanket segments, and a plurality of blankets, each blanket affixed to one of the plurality of blanket segments and each blanket having a printing surface;

disposing a first ink onto a first part of a first printing surface, the first part having a first outer surface that defines a first raised portion and a first recessed portion;

disposing a second ink onto a second part of the first printing surface, the second part having a second outer surface that defines a second raised portion and a second recessed portion;

contacting a first can body of the plurality of can bodies with the first printing surface, the contacting the first can body resulting in forming a first positive image on the first can body with the first raised portion of the first printing surface and forming a first negative image on the first can body with the second recessed portion of the first printing surface, the first negative image being inverse to the first positive image, wherein a length of the first printing surface is greater than a circumferential length of the first can body such that the first negative image overlaps the first positive image on the first can body;

disposing the first ink onto a first part of a second printing surface, the first part having a first outer surface that defines a first raised portion and a first recessed portion;

disposing the second ink onto a second part of the second printing surface, the second part having a second outer surface that defines a second raised portion and a second recessed portion; and contacting a second can body of the plurality of can bodies with the second printing surface, the contacting the second can body resulting in forming a second positive image on the second can body with the first raised portion of the second printing surface, the second positive image being different in form from the first positive image, and forming a second negative image on the second can body with the second recessed portion of the second printing surface, the second negative image being inverse to the second positive image and the second negative image being formed so as to align with the first positive image.

12. The method of claim 11 further comprising steps of disposing the first ink on to a first outer surface of each printing surface of the plurality of blankets and disposing the second ink onto the second outer surface of each printing surface, and contacting each printing surface with an additional can body of the plurality of can bodies, the contacting the additional can bodies resulting in, for each additional can body, forming a positive image and forming a negative image, the negative image being inverse to the positive image and the negative image being formed so as to align with the positive image.

13. The method of claim 11 wherein the steps of contacting each printing surface result in forming a positive image on each additional can body of the plurality of can bodies that is different in form from positive images formed on the other can bodies.

14. The method of claim 11 wherein the step of contacting the first can body with the first printing surface comprises continuous contact between the blanket and the first can body.

15. The method of claim 11 wherein the step of contacting the first can body results in forming a third positive image with the second raised portion of the second part of the first printing plate such that the first negative image is disposed within the second positive image.

16. The method of claim 15 wherein the step of contacting the second can body results in forming a fourth positive image with the second raised portion of the second part of the second printing plate such that the second negative image is disposed within the fourth positive image, the fourth positive image being different in form from the third positive image.

17. The method of claim 11 wherein the first part of the first printing surface further comprises a third raised portion and a third recessed portion, and the step of contacting the first can body results in forming a third positive image with the third raised portion and forming a third negative image with the third recessed portion, the third negative image being inverse to the third positive image and the third negative image being formed so as to align with the third positive image.

18. The method of claim 17 wherein the step of disposing the first ink includes disposing the first ink onto the first raised portion of the first part of the first printing surface and the method further comprises a step of disposing a third ink onto the third raised portion of the first printing surface.

19. The method of claim 18 wherein the first ink is a different color from the third ink.

20. The method of claim 17 wherein the first part of the second printing surface further comprises a third raised portion and a third recessed portion, and the step of contacting the second can body results in forming a fourth positive image with the third raised portion, the fourth positive image being different in form from the third positive image and forming a fourth negative image with the third recessed portion, the fourth negative image being inverse to the fourth positive image and the fourth negative image being formed so as to align with the fourth positive image.

* * * * *